US005793401A

United States Patent [19]

Peter

[11] Patent Number: 5,793,401

[45] Date of Patent: Aug. 11, 1998

[54] DEVELOPER DEVICE AND CONTRA-PHOTOGRAPHY INSTRUMENT

[75] Inventor: Gunter Jakob Peter, Plons, Switzerland

[73] Assignee: Pelikan Produktions AG, Switzerland

[21] Appl. No.: 683,036

[22] Filed: Jul. 16, 1996

[30] Foreign Application Priority Data

Jul. 20, 1995 [CH] Switzerland ..... 02 136/95-0

[51] Int. Cl.[6] ..... B41J 2/385

[52] U.S. Cl. ..... 347/142; 347/158

[58] Field of Search ..... 399/270, 272, 399/281, 285; 347/158, 153, 151, 142, 141, 124

[56] References Cited

U.S. PATENT DOCUMENTS

| | | |
|---|---|---|
| 3,743,411 | 7/1973 | Kkrekow et al. . |
| 4,118,710 | 10/1978 | Tomita et al. . |
| 4,281,622 | 8/1981 | Kudo et al. . |
| 4,378,158 | 3/1983 | Kanbe . |
| 4,624,559 | 11/1986 | Haneda et al. . |
| 4,777,499 | 10/1988 | Okuna et al. . |
| 4,809,034 | 2/1989 | Murasaki et al. . |
| 5,140,373 | 8/1992 | Ikegawa et al. . |
| 5,229,825 | 7/1993 | Yousey et al. . |
| 5,412,456 | 5/1995 | Tanuma et al. . |
| 5,495,322 | 2/1996 | Wada et al. . |

FOREIGN PATENT DOCUMENTS

| | | |
|---|---|---|
| 0 055 599 | 7/1982 | European Pat. Off. . |
| 57-196268 | 2/1983 | Japan . |
| 58-018657 | 4/1983 | Japan . |
| 58-171975 | 1/1984 | Japan . |
| 61-062084 | 8/1986 | Japan . |
| 02-196669 | 3/1990 | Japan ..... 347/151 |

*Primary Examiner*—Robert Beatty

*Attorney, Agent, or Firm*—Fay, Sharpe, Beall, Fagan, Minnich & McKee

[57] ABSTRACT

An electro-photograph device having two counter-rotating rolls (2, 5). Roll (2) transports a toner layer, controlled by a blade (4), to a printing zone (6). A voltage is applied between rolls (2, 5), in order to transfer low-adhesion toner from roll (2) to roll (5). Consequently, only toner particles having a specified minimum adhesion reach the printing zone (6). Thus, better print quality is obtained and the expenditure for drive electronics is reduced. A multitude of electrodes (18) are located on the side of a paper carrier facing away from the roll (2). A switching device (19) selectively applies the electrodes with a bias with is related to the biases applied to the rolls (2,5).

7 Claims, 3 Drawing Sheets

DEVELOPER DEVICE AND CONTRA-PHOTOGRAPHY INSTRUMENT

BACKGROUND OF THE INVENTION

In electro-photography—also known under the name of Xerox Process, and in other electro-photographical processes (printing by means of electrical current or electrical voltage) electrically charged pigment particles (Toner)—under the influence of print-focal electrical fields are developed on a sub-carrier (Xerox Process) or are reproduced directly on the information carrier. A developer device which is customary in electro-photography is represented in FIG. 1. In order to be able to electrically develop toner on an information carrier, it is necessary to first charge these pigment powders electrically. This is mostly done through friction of the toner, for example with the surface of a developer roll or a transport roll 2. With appropriate selection of the tribo-electrical partners, one thus achieves a defined charge of the pigment powder. Adhesion of the toner now occurs electro-statically on the surface of the transport roll or additionally via a magnetic field, if the toner can be magnetized or carries a permanent magnetic moment. In the latter case, an appropriately designed permanent magnet is then stored on the inside of the transport roll. Both the sinternally stored magnet can be turned in this case for transport. Before the toner gets into the development zone 6, the excess toner is scraped off by means of a type of blade, either strictly mechanically or magnetically. Thus there is produced a well-defined, thin layer of the toner.

Conditioned by the manufacturing process and additional influence factors, the magnetic moment and the electrical charge of the pigment particles and, consequently, their adhesion to the surface of the developer roll are subjected to a distribution. In actual practice one encounters a so-called development curve as illustrated in FIG. 2. The flow of the pigment particles detached from the developer surface and impingement upon the information carrier or an intermediary reservoir, depends upon the electrical field force at the site of the developer surface. In FIG. 2, the relationship is indicated with the electrical potential difference (voltage) between the developer surface and the information carrier as the parameter (by the physical definition: electrical field force=−grad $\Phi$, whereby $\Phi$ stands for the electrical potential,—the electrical field force can be determined at the site of the developer surface as voltage divided by the distance of the two areas, in case of homogenous electrical field). Analogous to the behavior of a Geiger-Muller counter tube, one can distinguish four areas in FIG. 2. In Area I, one speaks of start-up behavior. Area II is designated as proportional area (here the applied voltage and the particle current are proportional to each other), Area III is called the transition area and Area IV is called the saturation area. With respect to general application, Areas II and IV are of particular interest. In Area II it would be possible to directly control the per time unit number of pigment particles impinging upon the information carrier, and thus the resulting color hue, by means of the applied electrical voltage between developer surface and information carrier. In Area IV, one could control the color hue by the duration of the applied voltage.

The fact, however, is bothersome that in order to get into these areas, one will have to first cross with the applied voltage in Area I, Areas I–III respectively, and one will thus have to put up with deviations from the ideal course.

SUMMARY OF THE INVENTION

The present invention is based on the objective of optimizing the form of the development curve. Said objective is solved by the combination of the characteristics of the claims. Electro-photographical processes, in which the electrical field is generated by means of force-wired miniaturized electrodes for reproduction of the toner on the information carrier, are beneficially supplemented by the present invention.

BRIEF DESCRIPTION OF THE DRAWINGS

The above and other objects and advantages of the invention will become apparent from the following description when read in conjunction with the accompanying drawings, wherein.

DETAILED DESCRIPTION OF THE PREFERRED EMBODIMENT

Figure 1:
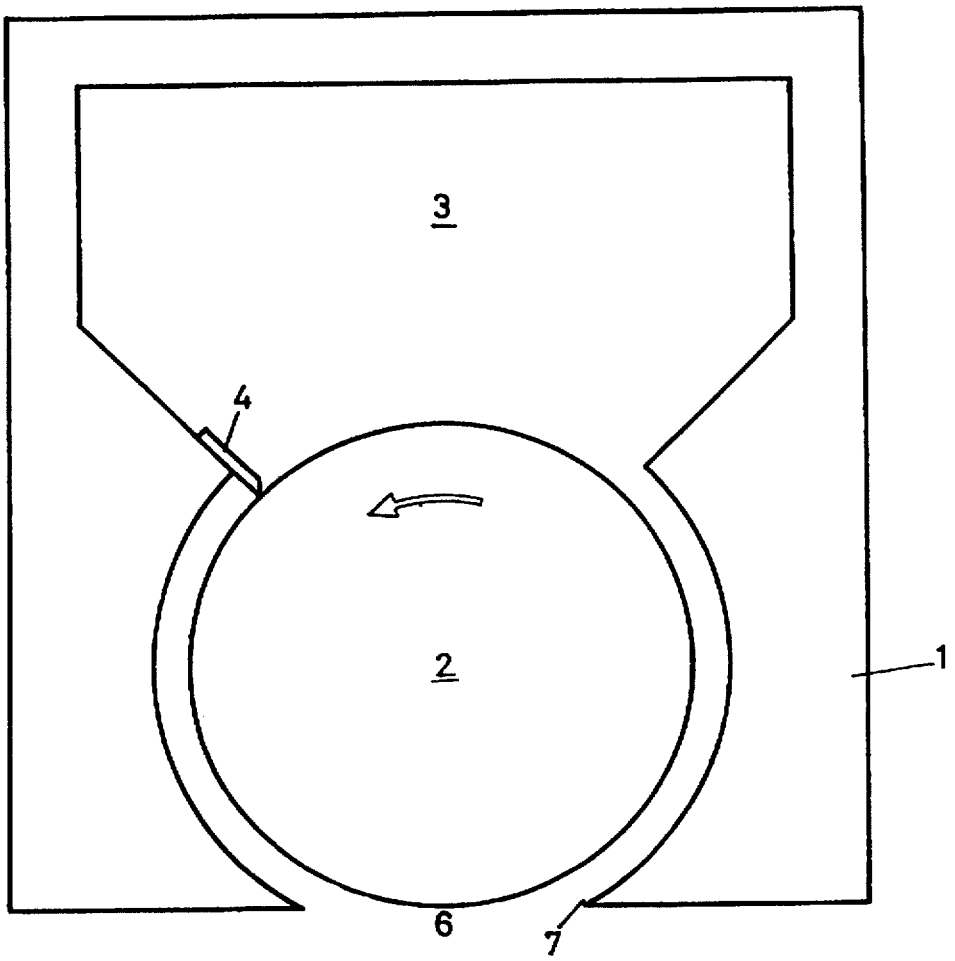
Fig. 1 Prior Art
FIG. 1 is a diagrammatic illustration of a prior art developer device for electro-photography.
Figure 2:
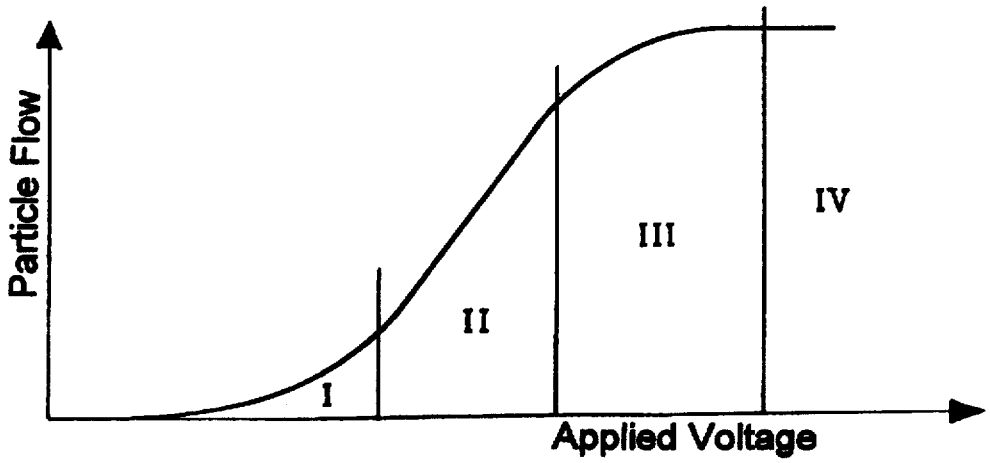
Fig. 2 Prior Art
FIG. 2 is a typical development curve for the device of FIG. 1.
Figure 3:
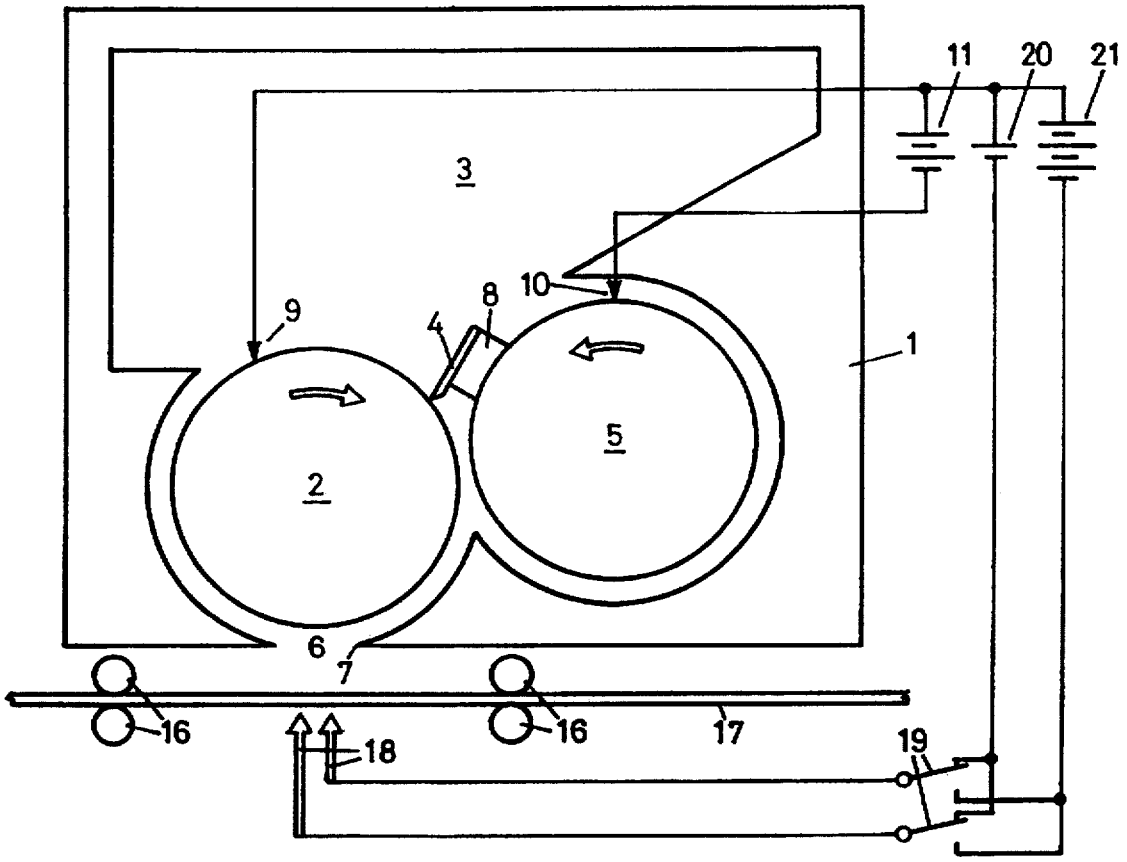
FIG. 3 is a somewhat diagrammatic representation of a developer device incorporating the invention.

Referring in particular to FIG. 3, there is shown a housing 1 in which there is rotatably positioned a developer roll 2, known per se. Above roll 2 there is a storage space 3 for the toner. When in operation, roll 2 turns in the direction of the arrow. In order to produce a defined toner layer on roll 2, there is arranged a blade 4 at a predetermined small distance from roll 2. Also mounted in housing 1 and parallel to the axis of roll 2 but spaced at a small distance therefrom is a second counter-rotating cleaning roll 5. The smallest distance between rolls 2, 5 is located in the rotational direction of roll 2, after the blade 4 but before the printing zone 6, at the opening 7 of housing 1. Likewise, upstream from the narrowest location between rolls 2, 5, there is a cleaning device 8 for mechanically scraping the toner off roll 5. For example, the cleaning device 8 can be a strip of felt.

Wiper contacts 9, 10 rest against the inside or the outside of rolls 2, 5. By means of a voltage source 11, direct voltage is applied between rolls 2, 5. Thereby, at the narrowest location between rolls 2, 5, toner from roll 2 is collected onto roll 5, that is to say only those toner particles with relatively weak adhesion, because, for example, of a weak electrostatic charge. As a result of this, the toner particles transported on roll 2 to the development zone 6, have a predetermined minimum adhesion on roll 2. Depending upon the type of toner utilized, rolls 2, 5 can additionally contain magnetic cores in the interior (not shown).

In FIG. 3, the device is shown in application for contra-photographic reproduction. For that purpose an information carrier, for instance paper 17, is passed along the printing zone 6 by means of rolls 16. Below the paper 17, opposite the printing zone 6, there is arranged a multitude of printing electrodes 18. In the illustration according to FIG. 3, only two of these electrodes 18 are visible. The remaining electrodes are arranged, in a specified pattern, staggered, in the axial direction of roll 2. For better clarity, the distance between roll 2 and paper 17 or electrodes 18 is shown excessively large. By means of switch 19, the electrodes 18 can optionally be applied to one of two voltage sources 20, 21, wherein one of the voltages, compared to the voltage of roll 2, is lower and the other one higher than the voltage applied to roll 5 by the voltage source 11.

Figure 4A:
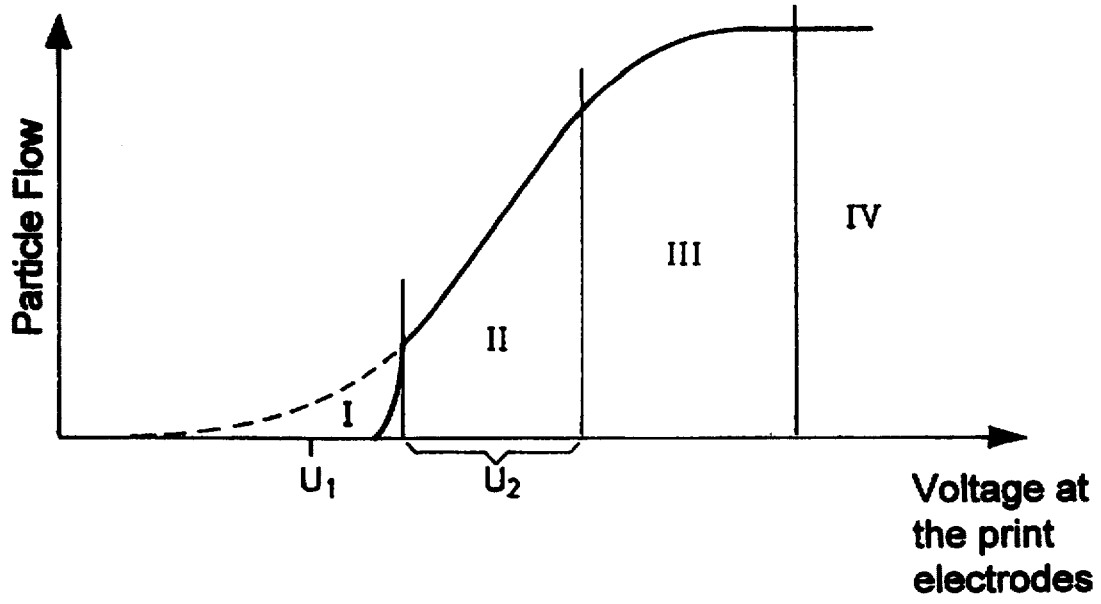
FIGS. 4*a* and 4*b* are development curves for the device of FIG. 3.
Figure 4B:
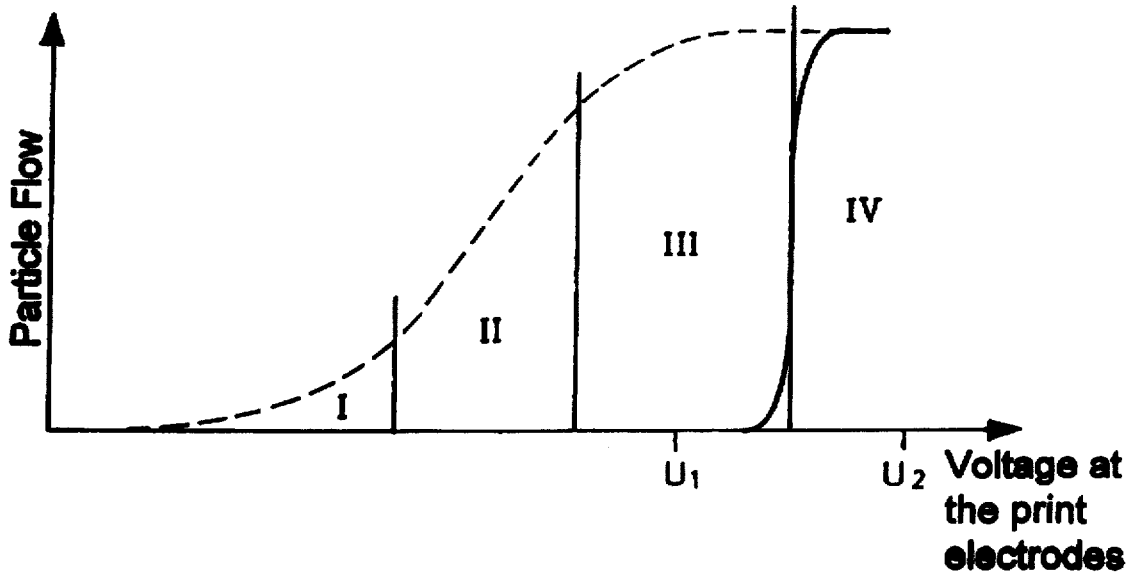

As a result of the described specific embodiment, it is achieved that the toner particles with low adhesion are transferred from roll 2 onto roll 5, so that only toner particles with a specified minimum adhesive force on roll 2 will reach printing location 6. Thereby, the development curve is changed in the sense of the representation according to FIGS. 4a–4b. Depending upon the voltage applied to roll 5, there is produced a development curve according to FIG. 4a. Here, the area I of the original development curve, indicated in dotted line, is practically cut off. This operating mode is suitable if one wants to operate in the proportional area II. If, however, one wants to operate in the saturation area IV, a higher voltage is applied to roll 5, so that the development curve according to FIG. 4b is produced. In this instance, the areas I to III of the original development curve are cut off.

Another benefit results from the device according to the invention, in electro-photographic processes, in which direct voltage levels are wired. Due to the attained modification of the development curve, a significantly lower voltage increase can be used for printing. As shown in FIG. 4a, the voltage at the electrodes 18 need only be switched between $U_1$ and the area $U_2$, instead of between zero and $U_2$. If one operates in the saturation area IV according to FIG. 4b, one must switch between $U_1$ and $U_2$, instead of between zero and $U_2$. Consequently, the requirements with respect to drive electronics for printing are essentially reduced and significantly less costly building components can be used.

Having thus described the invention, it is claimed:

1. In a developer device for an electro-photographic instrument and having a toner storage chamber with an opening on one side closed off by a movable developing member, with a blade, immediately adjacent to the developing member in order to form on the moved developing member a toner layer and, wherein during operation, the developing member moves from the blade to a development zone at the opening, in which the developing member is passed next to a paper carrier, the improvement wherein between the blade and the development zone with respect to the circumference of the developing member, closely adjacent the developing member there is arranged a movable cleaning member, and means for applying an electrical voltage between the developing member and the cleaning member for transferring toner particles having low adhesion from the developing member to the cleaning member;

a transport device for moving a paper carrier relative to the developing member adjacent to the development zone;

a multitude of electrodes on a side of the paper carrier facing away from the developing member, and a switching means for individually, selectively connecting the electrodes with a voltage source which has a greater voltage difference vis-a-vis the developing member than the cleaning member, the switching means switches the electrodes between first and second voltage values, wherein the first voltage value is smaller and the second voltage value greater than the voltage of the cleaning member relative to the developing member, the first voltage value being between the voltage of the developing member and the voltage of the cleaning member.

2. The improvement according to claim 1 wherein a cleaning device for cleaning of the cleaning member arranged upstream from a location of least distance between the developing and cleaning members, in order to clean the cleaning member of toner particles.

3. The improvement according to claim 1 wherein the developing and cleaning members are each formed by peripheries of cylindrical, rotatably positioned drums.

4. The improvement according to claim 1 wherein the electrical voltage is a direct voltage.

5. The improvement according to claim 1 wherein the means for applying an electrical voltage charges the developing and cleaning members such that toner particles having a charge less than a predetermined charge are transferred from the developing member to the cleaning member.

6. In a developer device for an electro-photographic instrument and having a toner storage chamber with an opening on one side closed off by a movable developing member, a blade disposed immediately adjacent to the developing member for forming a toner layer on the moveable developing member and, wherein during operation, the developing member moves from the blade to a development zone at the opening, in which the developing member forms an image on a recording medium at the development zone with the toner layer, a method comprising:

providing a movable cleaning member closely adjacent the developing member with respect to a circumference of the developing member;

moving the recording medium adjacent the developing member at the development zone;

applying an electrical voltage between the developing and cleaning members; and transferring toner particles having a charge less than a predetermined charge from the developing member to the cleaning member such that toner particles on the developing member having a charge greater than the predetermined charge are attached to the developing member at the development zone.

7. The method as set forth in claim 6 further comprising providing a plurality of electrodes adjacent the developing member at the development zone such that the recording medium is moved between the plurality of electrodes and the development zone.

* * * * *